United States Patent [19]

Bellio

[11] Patent Number: 4,991,528

[45] Date of Patent: Feb. 12, 1991

[54] METHOD AND APPARATUS FOR DETECTING IMPROPER STITCHES FOR A CHAINSTITCH SEWING MACHINE

[75] Inventor: Stephen L. Bellio, West Roxbury, Mass.

[73] Assignee: The Charles Stark Draper Laboratory, Inc., Cambridge, Mass.

[21] Appl. No.: 332,227

[22] Filed: Mar. 31, 1989

[51] Int. Cl.[5] ..... D05B 69/36

[52] U.S. Cl. ..... 112/278; 112/197; 112/262.1

[58] Field of Search ..... 112/278, 273, 197, 262.1; 250/233, 560, 571; 242/37 R

[56] References Cited

U.S. PATENT DOCUMENTS

| | | | |
|---|---|---|---|
| 3,785,308 | 1/1974 | Brandriff et al. | 112/278 |
| 3,843,883 | 10/1974 | De Vita et al. | 112/273 X |
| 4,102,283 | 7/1978 | Rockerath et al. | 112/131 |
| 4,186,672 | 2/1980 | Burton | 112/273 |
| 4,192,243 | 3/1980 | Blessing et al. | 112/273 |
| 4,196,685 | 4/1980 | Tamura | 112/278 X |
| 4,602,582 | 7/1986 | Rawson | 112/273 X |

*Primary Examiner*—Peter Nerbun

*Attorney, Agent, or Firm*—Lahive & Cockfield

[57] ABSTRACT

A method and apparatus for detecting an improper stitch for a Class 400 chainstitch sewing machine. A monitor assembly determines the consumption per stitch of the looper thread during the formation of the chainstitches. A processor identifies times when the monitored consumption is indicative of looper thread consumption per stitch below a predetermined threshold value. Since the consumption per stitch for looper thread is nominally a predetermined multiple of the stitch length, those identified times correspond to times when improper stitches have occurred.

17 Claims, 6 Drawing Sheets

STITCH TYPE 404

STITCH TYPE 406

STITCH TYPE 407

METHOD AND APPARATUS FOR DETECTING IMPROPER STITCHES FOR A CHAINSTITCH SEWING MACHINE

BACKGROUND OF THE INVENTION

This invention relates to an apparatus and method for monitoring the stitching quality of sewing machines and, in particular, to detecting skipped and malformed stitching for Class 400 chainstitch sewing machines.

With the clothing industry becoming increasingly automated, there is a need for systems that monitor and regulate the functions and output of high speed sewing equipment. Certain of these systems are utilized to monitor the stitching of sewing machines to detect malformed or skipped stitching in apparel manufactured by Class 400 chainstitch sewing machines. The Class 400 chainstitch is employed in a wide range of areas within the apparel industry because it provides a fast, economical, resilient, and strong stitch chain. The Class 400 stitch tends to be very elastic and is well suited for seaming operations, for example, inseaming pants and closing synthetic bags, on wovens and knits of many types and weights of materials. However, in Class 400 chainstitch, malformed or skipped stitching tend to weaken the entire stitch chain and, as a result when included in the final product, the defective product may prematurely fail, for example by unraveling.

The 400 Class "multi-thread chainstitch" is formed by a sewing machine passing one or more needle thread loops through the material. Those needle thread loops are interlooped on the underside with a looper thread supported on a looper As an exemplary Class 400 chainstitch, stitch type 401 is formed with two threads, the needle thread and the looper thread. An angularly reciprocal looper, located underneath the material, engages the needle loop projected by an axially reciprocal needle underneath the material. The looper retains the needle loop when the needle is retracted and, in addition, draws the looper thread from the previous stitch through the needle loop. The needle then penetrates the material again between the looper thread and the previous needle loop. As a result, when the looper retracts, the needle thread, which comprised the needle loop, tightens and thus completes a stitch. A more detailed description of the chainstitch type 401 is provided in Union "Special Stitch Formation Type 401" brochure, published by Union Special Huntley, Illinois (1979).

In the general use of chainstitch type 401 sewing machines, improper stitches maY from time to time be introduced in a workpiece. Generally, improper stitches may have the form of malformed stitches or skipped stitches. Collectively, these malformed and skipped stitches are referred to as "improper stitches" hereinbelow. There are many causes of improper stitches. Malformed stitches can develop from improper synchronization between the active elements within the sewing machine and the needle and looper thread loops. In particular, the malformed stitches are formed when the needle thread loop around the blade of the looper is improperly positioned and as a result the needle on its downward travel can enter this loop, forming a "101-type" stitch.

In general, skipped stitches also result from improper synchronization of the needle thread loop and the looper thread loop and may also occur from deflection of the needle. There are primarily two types of skipped stitches: the "needle loop" skip and "triangle" skip. The needle loop skip develops when the looper fails to enter the needle loop and as a result the upward motion of the needle, the needle thread controls, and the feed motion pull the loop to the top of the fabric The triangle skip is formed not by the looper failing to enter the needle loop, but when the needle fails to enter the looper loop. Consequently, since the needle loop was picked up by the looper, the needle thread remains in the material or is loose on the top side of the fabric.

In the prior art, skipped stitch detection systems are based upon monitoring the tension of the looper thread and/or the needle thread. As detailed in Rockerath et al., U.S. Pat. No. 4,102,283, the loss of thread tension generally said to correspond to a skipped stitch and this reduction in normal thread tension triggers a sensing device. The sensitivity of these systems ranges from complete loss of thread tension, for example, due to the thread breaking, to sensing a momentary reduction in the normal thread tension.

A primary shortcoming of the prior art is the unreliability of these systems at high sewing speeds, for example, greater than 9,000 stitches per minute. These systems fail to detect a momentary reduction of thread tension when the sewing machine is operating at high sewing speeds. The reduction in tension for a malformed or skipped stitch at high sewing speeds tends to be less and in a range that the prior art fails to detect As a result, these systems tend to be less reliable and thus fail to perform these functions with great accuracy.

There exists a need for better methods and systems that are reliable at high sewing speeds. To accommodate the advances in the clothing automation, particularly the increase in sewing speeds, a simple, reliable system for monitoring the malformed and skipped stitches would satisfy a substantial need in the art.

SUMMARY OF THE INVENTION

The present invention is a method and apparatus for detecting an improper stitch for a Class 400 chainstitch sewing machine. Generally that type of sewing machine includes an axially reciprocable needle adapted to incorporate one or more needle threads into a succession of Class 400 chainstitches and includes a reciprocable looper adapted for incorporating a looper thread into the chainstitches.

To detect improper stitches, a monitor assembly determines the consumption per stitch of the looper thread during the formation of the chainstitches. A processor identifies times when the monitored looper thread consumption per stitch is below a predetermined threshold value. Since the consumption per stitch for looper thread is nominally a predetermined multiple of the stitch length, those identified times correspond to times when improper stitches have occurred.

In one form of the invention, the looper thread monitor assembly includes an encoding wheel arranged so that the looper thread is disposed about and frictionally coupled to a portion of the periphery of the encoding wheel between the source of the looper thread and the looper. This encoding wheel provides a looper thread signal representative of the angular position of the encoding wheel where thread consumption corresponds to a change in angular position of the encoding wheel. The monitor assembly further detects the completion of individual stitches.

In one form, this portion of the monitor assembly includes a sensor arranged for detecting sewing machine shaft rotation. This provides a means for counting stitch cycles. The sensor outputs one stitch-completed signal every rotation of the sewing machine shaft. The processor, responsive to the looper thread signal and the stitch signal, determines if a stitch is proper or improper by comparing looper thread consumption per stitch with a predetermined threshold value.

In one form of the invention, the looper thread monitor assembly further comprises a first spring biased tension element having a portion of its periphery in sliding contact with the looper thread between the encoding wheel and the looper. That monitor assembly further includes a second spring biased tension element having a portion of its periphery in sliding contact with the looper thread between the encoding wheel and the looper thread source. The first and second tension elements are cooperatively adapted to maintain the looper thread in frictional contact with the portion of the periphery of the encoding wheel. The tension elements permit rapid acceleration of the encoding wheel during high speed operation. Further, a brake assembly applies a predetermined counter-rotational drag force to the encoding wheel, thereby permitting rapid deceleration of that wheel during high speed operation.

The looper thread monitor may include an optical encoder having an optical beam generator directed along an optical axis to a photodetector. A beam chopper is integrally coupled to the encoding wheel, whereby optical radiation from the beam generator is alternately incident on and blocked from the detector as the encoding wheel rotates in response to axial motion of the looper thread. The beam generator may be positioned so that the beam is generated along a beam axis coaxial with the rotational axis of the encoding wheel. A mirror may be positioned along the beam generator axis so that the optical axis is folded approximately ninety degrees. With the latter configuration, a compact, highly responsive improper stitch detection system may be implemented for Class 400 chainstitches.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1A:
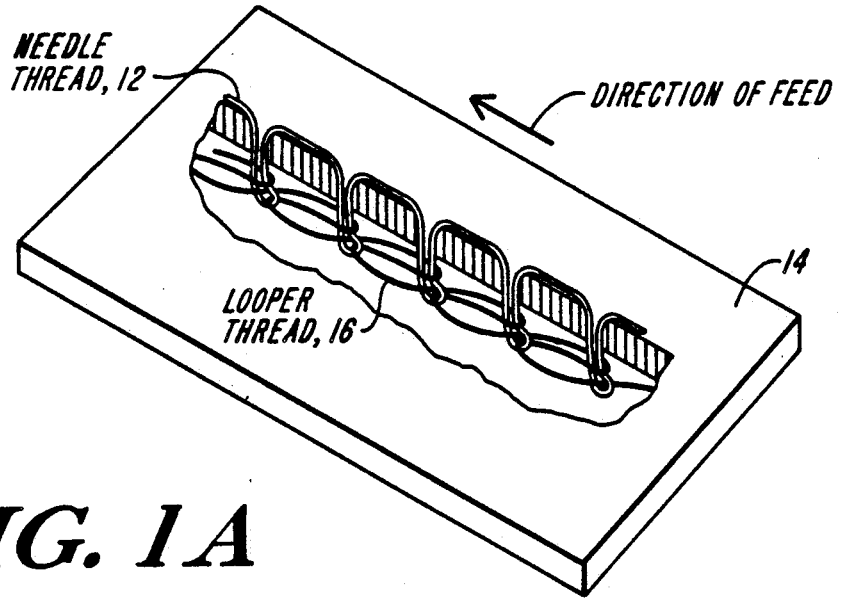
FIG. 1A shows in diagrammatic form an exemplary Class 400 chainstitch type 401.

A diagrammatic representation of Class 400 chainstitches, types 401, 404, 406, and 407 are shown in FIGS. 1A-1D. In those figures, the needle threads 12 generally run along the top of a limp material segment 14, passing loops through the segment 14 at periodic intervals. The looper thread 16 runs along the bottom of segment 14, cyclically passing from one of the needle thread loops in each thread to the next and then returning to and passing around the first and continuing on to pass through the next needle thread loop of each thread In the illustrated stitch configurations, the needle thread loops are shown with exaggerated length for clarity. When the finished stitch is at proper tension, there are several times as much looper thread as needle thread (for each needle) on a per stitch basis. For the chainstitch type 401, the ratio of looper thread to needle thread is approximately three.

The chainstitch type 401 is formed by passing the looper loop through the needle loop and then the needle loop through the looper loop or triangle. There are two basic types of skip stitches that can occur: the "needle loop" skip and the "triangle" skip.

Figure 2A:
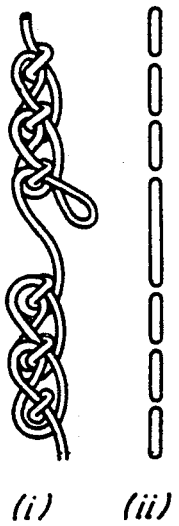
FIGS. 2A, (i) and (ii), show the bottom and top, respectively, of an exemplary chainstitch type 401 having a needle loop skip improper stitch.

The needle loop skip (shown in FIGS. 2A, (i) and (ii)), may be identified by the needle thread laying tightly on the top side of the fabric and the looper thread twisted around the needle loop of the next properly formed stitch. The looper missing the needle loop is the cause of the skip. The upward motion of the needle, the needle thread controls, and feed motion pull the needle loop to the top of the fabric.

Figure 2B:
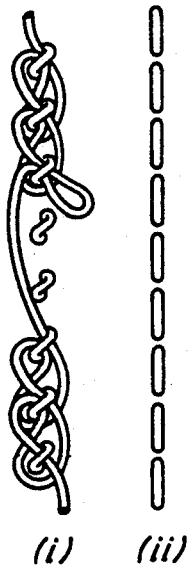
FIGS. 2B, (i) and (ii), show the bottom and top, respectively, of an exemplary chainstitch type 401 having a triangle skip (looper thread side) improper stitch.
Figure 2C:
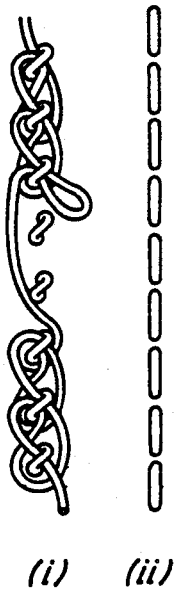
FIGS. 2C, (i) and (ii), show the bottom and top, respectively, of an exemplary chainstitch type 401 having a triangle skip (needle loop side) improper stitch.

The triangle skip can occur on either the "looper thread side" (shown in FIGS. 2B, (i) and (ii)), of the triangle or the "needle loop side" (shown in FIGS. 2C, (i) and (ii)). Both triangle skips are usually identified by the needle thread loop remaining in the material or lying loosely on the top of the fabric. However, the looper thread of a skip to the "looper thread side" is not twisted around the needle loop of the next properly formed stitch. The looper thread of a skip to the "needle loop side" will be twisted around the needle loop. The needle missing the looPer loop or triangle is the cause of this skip Because the needle loop was picked up by the looper on the motion to the left, the needle thread remains in the material or is loose on the top side of the fabric.

Figure 2D:
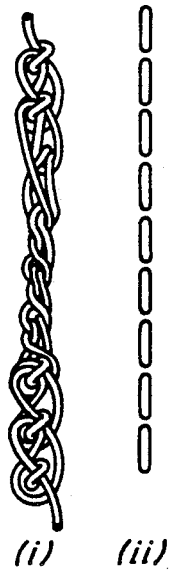
FIGS. 2D, (i) and (ii), show the bottom and top, respectively, of an exemplary chainstitch type 401 having a malformed stitch ("101" stitch) improper stitch.
Figure 2E:
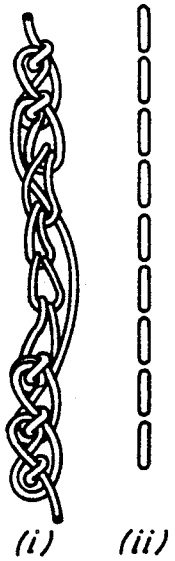
FIGS. 2E, (i) and (ii), show the bottom and top, respectively, of an exemplary chainstitch type 401 having a malformed stitch (needle loop twisted) improper stitch.
Figure 1B:
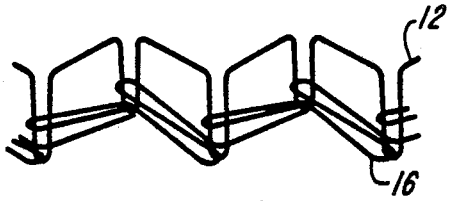
FIG. 1B shows in diaqrammatic form an exemplary Class 400 chainstitch type 404.
Figure 1C:
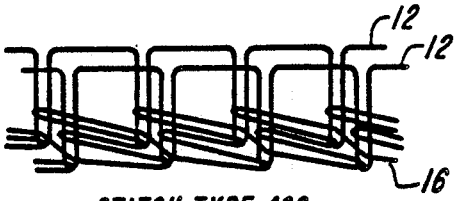
FIG. 1C shows in diagrammatic form an exemplary Class 400 chainstitch type 406.
Figure 1D:
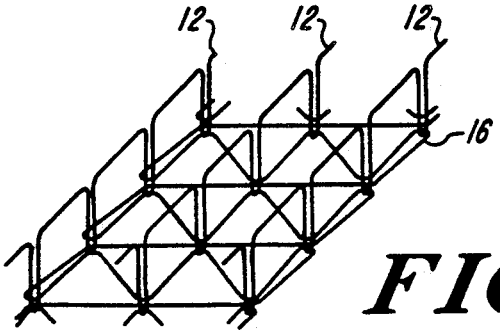
FIG. 1D shows in diagrammatic form an exemplary Class 400 chainstitch type 407.

Malformed stitches are shown in FIGS. 2D, (i) and (ii), where the needle thread loop around the blade of the looper was not positioned properly, and the needle on its downward travel entered this loop forming a malformed stitch appearing as a "101" stitch. Other malformed stitches are shown in FIGS. 2E, (i) and (ii), where depending on the direction in which the needle loop is twisted on the blade of the looper, the looper thread may or may not be twisted around the needle thread loops.

In the production of other Class 400 chainstitches, similar "improper stitches" may also be formed.

One characteristic of each of the improper stitches is that there is a significant decrease in looper thread consumption per stitch, compared with the thread consumption of a proper stitch. Based upon this characteristic of improper stitches, the present invention provides a method and apparatus for monitoring on a continuous basis the consumption of the looper thread and identifying times when this consumption drops below a predetermined value indicative of the formation of improper stitches. With the identification of such improper stitches, corrective action may subsequently be taken to ensure that high quality assembled workpieces are being produced.

The following description of a preferred embodiment is directed to a system for detecting improper stitches in a chainstitch type 401, but similar devices and techniques may be used in accordance with the invention for detection of improper stitches in other Class 400 chainstitches.

Figure 3:
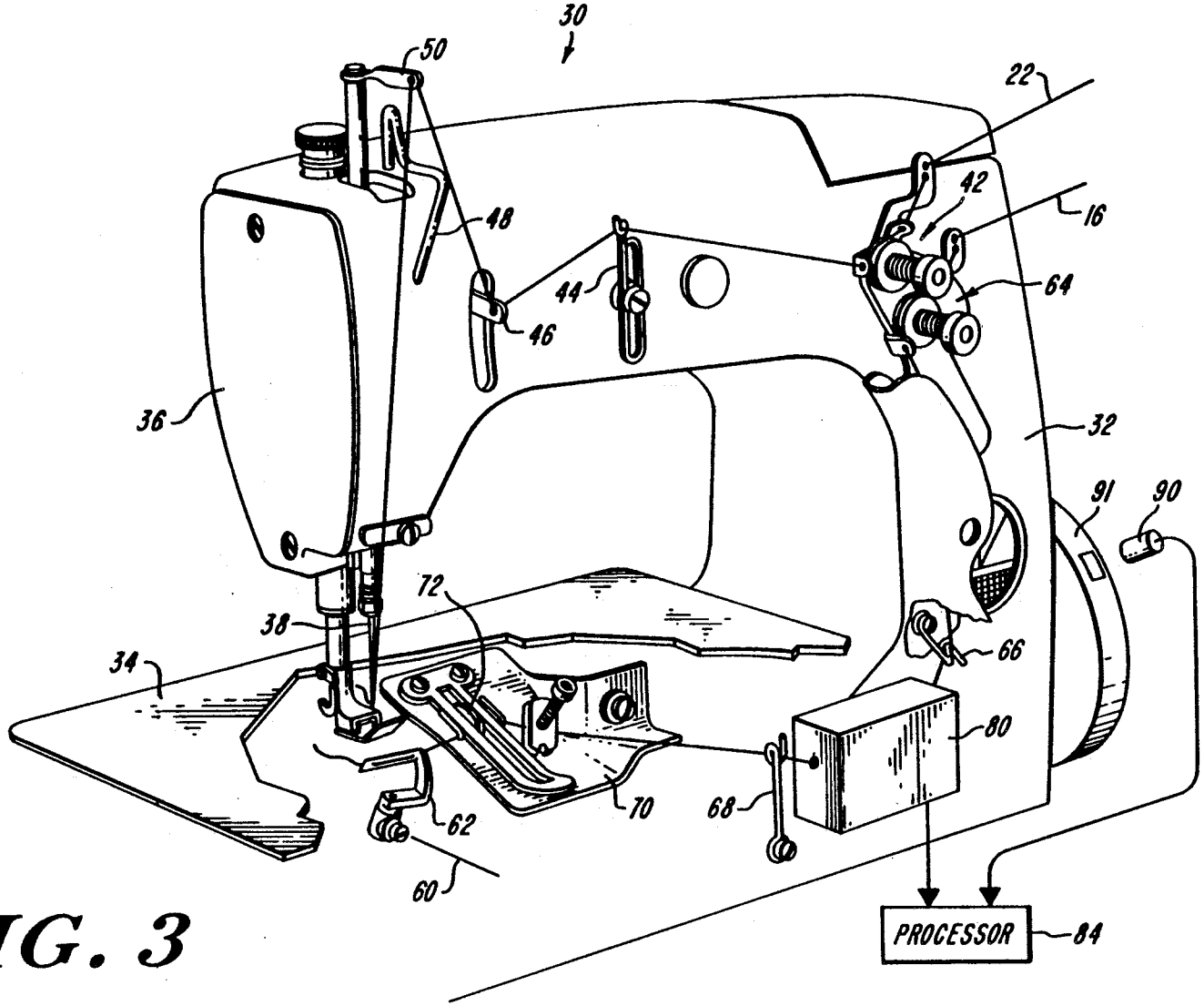
FIG. 3 shows, partially in cutaway view, a sewing machine including an improper stitch detection system embodying the present invention.

FIG. 3 shows a conventional chainstitch type 401 sewing machine 30 (such as the type 56300F, manufactured by Union Special, Huntley, Illinois) that has been modified to include an embodiment of the present invention. The sewing machine includes a base member 32 having a planar workpiece support surface 34, and having a sewing head 36 with a reciprocating needle 38 extending along a vertical needle axis. The needle 38 receives the needle thread 12 from a needle thread source (not shown) by way of a tension assembly 42, needle frame eyelet 44, needle lever eyelet 46, strike off wire 48, and needle bar eyelet 50.

Beneath the support surface 34, a looper assembly includes an angularly reciprocating (about axis 60) looper 62 which cooperates in a conventional manner with needle 38 to form type 401 chainstitches in a workpiece on surface 34. The looper 62 receives the looper thread 16 from a looper thread source (not shown) by way of a tension assembly 64, looper frame eyelets 66 and 68, cast off plate 70, and looper thread take-up cam 72.

The sewing machine 30 has been modified to include a looper thread monitor 80 which is positioned in the looper thread path between eyelets 66 and 68. The looper thread monitor 80 is electrically coupled along signal bus 82 to a processor 84. In addition, a sensor 90 is configured to detect individual shaft rotations of the wheel 91 of the sewing machine 30, where, in the illustrated embodiment, one rotation corresponds to one stitch. Thus, sensor 90 provides a stitch signal on bus 92 representative of the completion of individual stitches.

Figure 4:
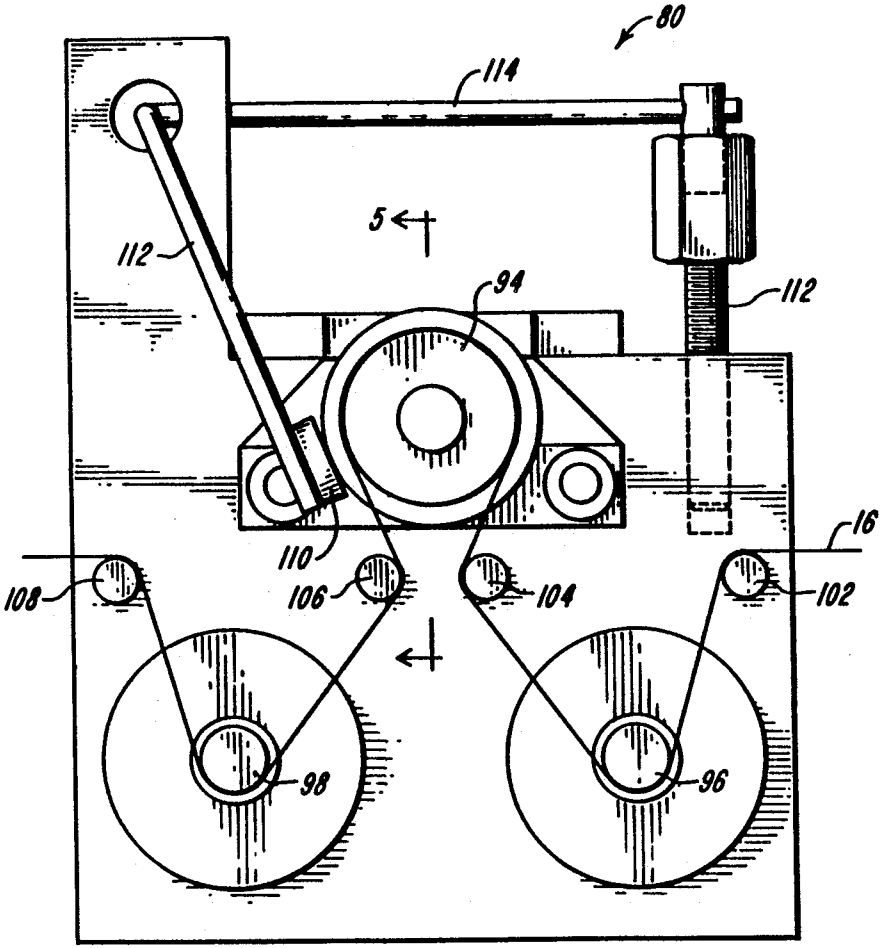
FIG. 4 shows a front view of the looper thread monitor of the system of FIG. 3.

The looper thread monitor 80 is shown in FIG. 4. Monitor 80 includes an encoding wheel 94, an input tension element 96, an output tension element 98, and smooth cylindrical bars 102, 104, 106, and 108, all of which cooperate to control the path of looper thread 16 between eyelets 66 and 68. The tension element 96 is spring biased to maintain the looper thread 16 in frictional engagement with a portion of the periphery of the encoder wheel 94 so that wheel 94 turns as the looper thread 16 moves, and permitting rapid acceleration of wheel 94 in response to axial motion of thread 16. The tension elements may be wheels, or non-rotatable elements, which are spring, or otherwise biased to apply a transverse deflecting force to thread passing by that element.

An adjustable drag brake assembly is adapted to provide a counter-rotational drag on the encoding wheel 94, permitting rapid deceleration of that wheel. The brake assembly includes a brake member 110 which is adjustably biased against wheel 94 by an adjusting screw 112. Screw 112 is coupled to member 110 by a resilient spring formed by torsionally coupled links 114 and 116.

Figure 5:
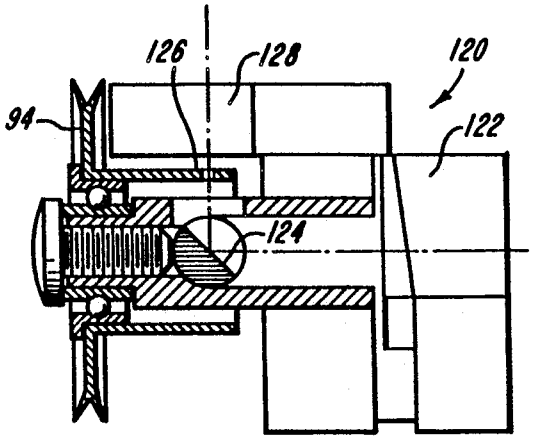
FIG. 5 shows a sectional side view along lines 5—5 of the encoding wheel and optical detection system of the monitor of FIG. 4.
Figure 6:
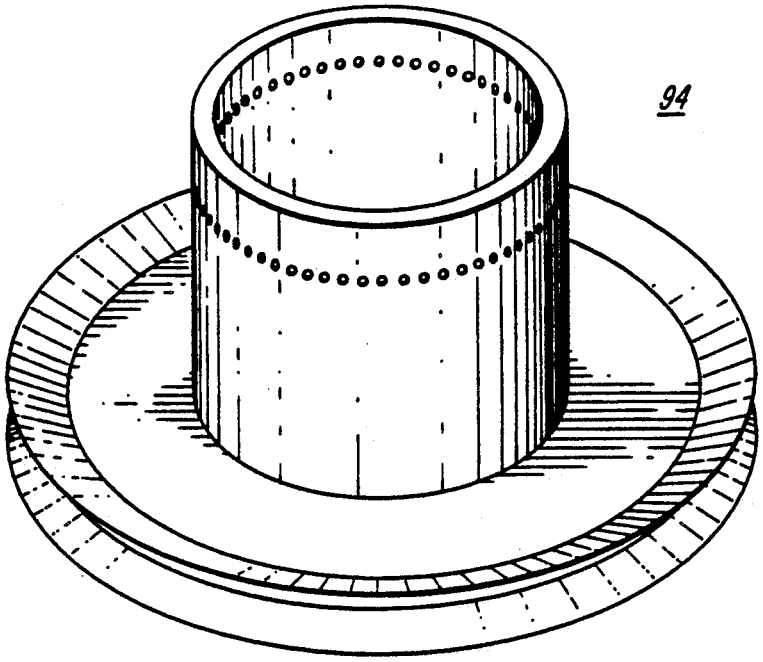
FIG. 6 shows a perspective view of the encoding wheel of the monitor of FIG. 4.
Figure 7:
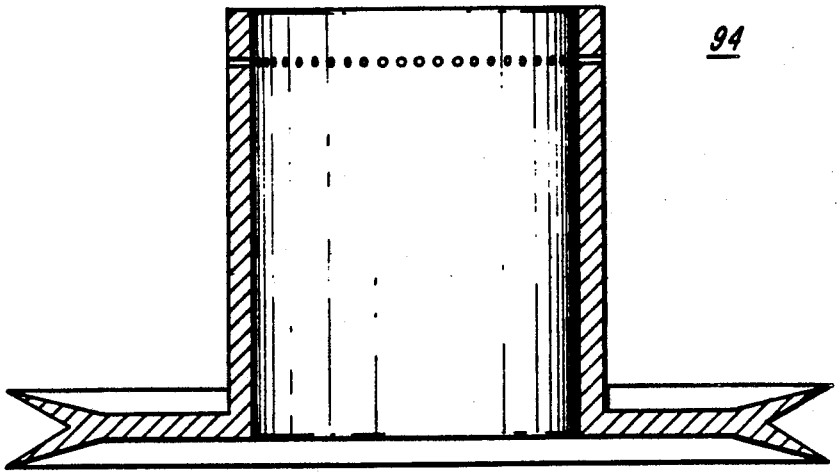
FIG. 7 shows a sectional view along lines 5—5 of the encoding wheel of the wheel of FIG. 4.

The encoding wheel 94 has an associated optical encoding system 120 The system 120 is shown in FIG. 5 and includes an optical source 122, mirror 124, a beam chopper 126, and an optical sensor 128. The encoding wheel, shown in detail in FIGS. 6 and 7, is a lightweight, machined aluminum wheel having a peripheral channel for guiding the looper thread 16. The shank of wheel 94 includes a set of holes on its circumference that, together with the interspaced portions of the shank, form the beam chopper 126. In the illustrated embodiment, the optical source 122 is the source portion of a Hewlett Packard type HEDS 9100-E optical encoder, aligned with its beam axis directed along the rotational axis of wheel 94. The mirror 124 is positioned along the beam axis to fold the beam path so that it passes radially away from its initial path and through a region swept by the holes in the shank of wheel 94. The optical sensor 128 is the sensor portion of the Hewlett Packard encoder, with its sensing axis aligned with the folded beam axis. With this configuration, as the wheel 94 rotates as a result of motion of looper thread 16, the sensor 128 provides a signal on bus 82 which is representative of that motion, and thus, looper thread consumption.

In the present embodiment, the processor 84 is a digital computer coupled to the data buses 82 and 92. That computer is responsive to the looper thread consumption signal on bus 82 and the stitch signal on bus 92 to identify times when the looper thread consumption (on a per stitch basis) is below a predetermined threshold value.

By way of example, an embodiment similar to the above-described embodiment, but using a Union Special XF600 sewing machine, was set up to form type 401 chainstitches ten stitches per inch running at a rate of 9,000 stitches per minute, where one stitch was formed in each revolution of the sewing machine (i.e. the needle passed through one full reciprocal motion for each revolution of the master drive motor of the machine). During stitch formation for the chainstitch type 401, the looper thread moves for two thirds of a revolution and is stopped for the other third. At 9,000 stitches per minute, the looper thread reaches speeds of 174 inches/-second. In the present embodiment, where the encoder wheel 94 has a 0.5 inch diameter, that wheel reaches speeds of 111 revolutions/second, or 6,667 rpm. In order to assure that the encoder wheel accurately tracked the looper thread motion, the tension elements were adjusted to generate sufficient frictional contact of the thread with the encoder wheel so that the thread could accelerate from 0 to 174 inches/second and back to 0 once per revolution (every 6.7 milliseconds) without slipping with respect to the wheel. Where there were 60 holes in the shank of the encoder wheel 94, yielding 240 counts per revolution (quadrature output). At the 9,000 stitches per minute rate, the system 80 generated 70 counts per stitch, corresponding to 0.46 inches/stitch.

Figure 8:
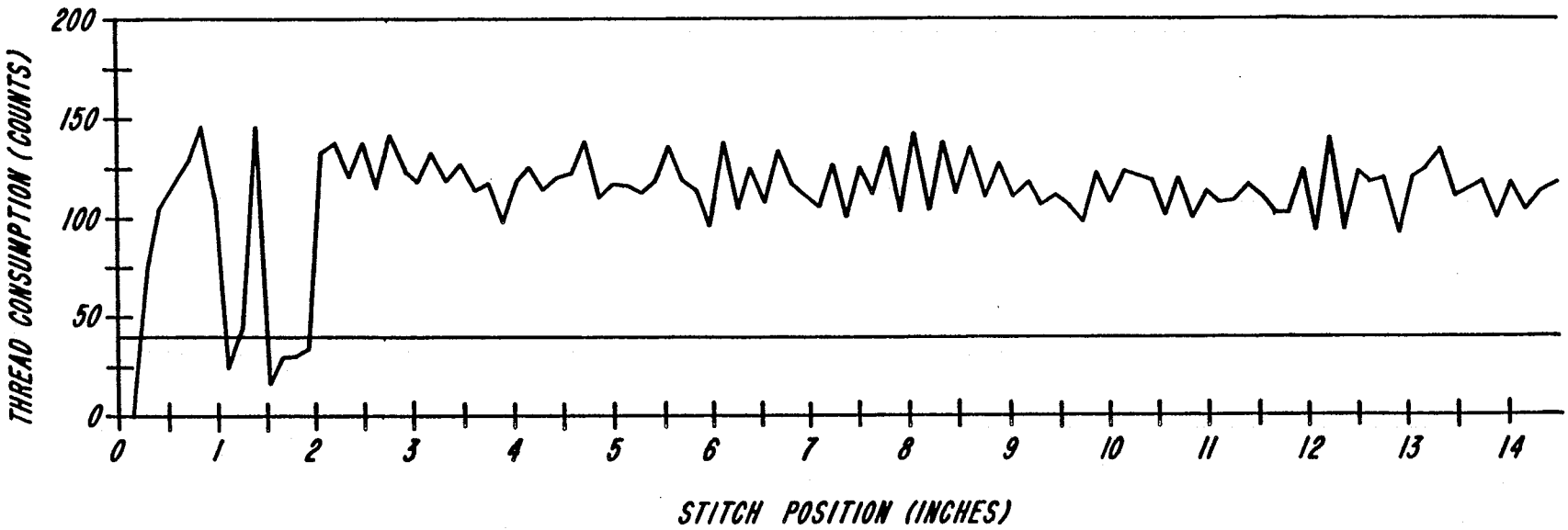
FIG. 8 shows a graphic representation of the signal showing locations of improper stitches in an exemplary chainstitch Type 401 sewn by a sewing machine embodying the present invention.

FIG. 8 shows a graphic representation of a signal produced by processor 84 for an exemplary row of stitches, where the row of stitches is a 6.4 stitches per inch chainstitch type 401 (with improper stitches) formed at 9,000 stitches per minute with the above-described configuration. In FIG. 8, where the looper thread consumption (in counts per stitch) is plotted against position along the chainstitch. In this example, the "improper stitch" threshold count value was set at 40. The occurrence of improper stitches are clearly identified in FIG. 8 by excursions of the thread count waveform below the horizontal threshold line.

While described above in conjunction with the chainstitch 401 improper stitch detection system, the thread monitor 80 may be used alone in other applications in which it is adapted to accurately measure rapid axial motions of thread, or similar elongated, flexible material.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. Apparatus for detecting an improper stitch for a Class 400 chainstitch sewing machine, said machine including an axially reciprocable needle adapted to incorporate one or more needle threads into a succession of Class 400 chainstitches and including a reciprocable looper adapted for incorporating a looper thread into said chainstitches, comprising:

looper thread means for monitoring the consumption per stitch of said looper thread during the formation of said chainstitches, processor means for identifying times when said monitored consumption is indicative of looper thread consumption per stitch below a predetermined threshold value, said identified times corresponding to times when improper stitches have occurred.

2. Apparatus according to claim 1 wherein said looper thread means includes an encoding wheel, said looper thread being disposed about and frictionally coupled to a portion of the periphery of said wheel between the source of said looper thread and said looper, and means for generating a looper thread signal representative of the angular position of said encoding wheel.

3. Apparatus according to claim 2 wherein said needle thread means further includes means for generating a stitch signal representative of said detected completion of individual stitches, wherein said processor is responsive to said looper thread signal and said stitch signal to generate a consumption signal representative of said monitored consumption per stitch of said looper thread.

4. Apparatus according to claim 2 wherein said looper thread means further comprises a first spring biased tension element having a portion of its periphery in sliding contact with said looper thread between said encoding wheel and said looper, and a second spring biased tension element having a portion of its periphery in sliding contact with said looper thread between said encoding wheel and said looper thread source, said first and second tension elements being cooperatively adapted to maintain said looper thread in frictional contact with said portion of the periphery of said encoding wheel.

5. Apparatus according to claim 4 wherein said looper thread means further comprises means for applying a predetermined counter-rotational drag force to said encoding wheel.

6. Apparatus according to claim 2 wherein said looper thread means includes an optical encoder, said optical encoder including an optical beam generator directed along an optical axis to a photodetector and a beam chopper integrally coupled to said encoding wheel, whereby optical radiation from said beam generator is alternately incident on and blocked from said detector as said encoding wheel rotates in response to axial motion of said looper thread.

7. Apparatus according to claim 6 wherein said beam generator is positioned whereby said beam is generated along a beam axis coaxial with the rotational axis of said encoding wheel, and further wherein said looper thread means comprises a mirror positioned along said generator axis whereby said optical axis is folded approximately ninety degrees.

8. Apparatus according to claim 1 wherein said sewing machine includes a drive motor having an output shaft adapted to drive said needle through one full reciprocal stitch-forming motion per shaft revolution, and wherein said detection means includes means for detecting each revolution of said shaft, each of said revolutions corresponding to completion of a stitch.

9. Method for detecting an improper stitch for a Class 400 chainstitch sewing machine, said machine including an axially reciprocable needle adapted to incorporate one or more needle threads into a succession of Class 400 chainstitches and including a reciprocable looper adapted for incorporating a looper thread into said chainstitches, comprising the steps of:

monitoring the consumption per stitch of said looper thread during the formation of said chainstitches, detecting the completion of individual stitches during the formation of said chainstitches, and identifying times when said monitored looper thread consumption per stitch is below a predetermined threshold value, said identified times corresponding to times when improper stitches have occurred.

10. Method according to claim 9 wherein said looper thread monitoring step includes the step of passing said looper thread about and in frictional contact with a portion of the periphery of an encoding wheel between the source of said looper thread and said looper, and generating a looper thread signal representative of the angular position of said encoding wheel.

11. Method according to claim 10 including the further step of generating a stitch signal representative of said detected completion of individual stitches, generating a consumption signal from said looper thread signal and said stitch signal, said consumption signal being representative of the looper thread consumption per stitch.

12. Method according to claim 10 wherein said looper thread means further comprises a first spring biased tension element having a portion of its periphery in sliding contact with said looper thread between said encoding wheel and said looper, and a second spring biased tension element having a portion of its periphery in sliding contact with said looper thread between said encoding wheel and said looper thread source, said first and second tension elements being cooperatively adapted to maintain said looper thread in frictional contact with said portion of the periphery of said encoding wheel.

13. Method according to claim 10 comprising the further step of applying a predetermined counter-rotational drag force to said encoding wheel.

14. Apparatus for detecting motion of thread between a source and a destination, comprising:

A. an encoding wheel, said thread being disposed about and frictionally coupled to a portion of the periphery of said wheel between the source of said thread and the destination of said thread, B. a first spring biased tension element having a portion of its periphery in sliding contact with said thread between said encoding wheel and said destination, C. a second spring biased tension element having a portion of its periphery in sliding contact with said thread between said encoding wheel and said thread source, said first and second tension elements being cooperatively adapted to maintain said thread in frictional contact with said portion of the periphery of said encoding wheel, whereby said wheel rotates in response to axial motion of said thread, and D. means for generating a thread signal representative of the angular position of said encoding wheel, where angular motion of said wheel corresponds to axial motion of said thread.

15. Apparatus according to claim 14 further comprising means for applying a predetermined counter-rotational drag force to said encoding wheel.

16. Apparatus according to claim 14 further comprising an optical encoder, said optical encoder including an optical beam generator directed along an optical axis to a photodetector and a beam chopper integrally coupled to said encoding wheel, whereby optical radiation from said beam generator is alternately incident on and blocked from said detector as said encoding wheel rotates in response to axial motion of said thread.

17. Apparatus according to claim 16 wherein said beam generator is positioned whereby said beam is generated along a beam axis coaxial with the rotational axis of said encoding wheel, and further wherein said looper thread means comprises a mirror positioned along said generator axis whereby said optical axis is folded approximately ninety degrees.

* * * * *